US010483027B2

(12) United States Patent
Miyamoto

(10) Patent No.: US 10,483,027 B2
(45) Date of Patent: Nov. 19, 2019

(54) COIL COMPONENT

(71) Applicant: MURATA MANUFACTURING CO., LTD., Kyoto-fu (JP)

(72) Inventor: Masashi Miyamoto, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 231 days.

(21) Appl. No.: 15/614,681

(22) Filed: Jun. 6, 2017

(65) Prior Publication Data

US 2018/0019046 A1 Jan. 18, 2018

(30) Foreign Application Priority Data

Jul. 15, 2016 (JP) ..... 2016-139852

(51) Int. Cl.

| | |
|---|---|
| ***H01F 27/00*** | (2006.01) |
| ***H01F 17/04*** | (2006.01) |
| ***H01F 27/29*** | (2006.01) |
| ***H01F 41/06*** | (2016.01) |
| ***H01F 41/10*** | (2006.01) |
| *H01F 27/28* | (2006.01) |
| *H01F 41/04* | (2006.01) |

(52) U.S. Cl.

CPC ..... *H01F 17/045* (2013.01); *H01F 27/29* (2013.01); *H01F 41/06* (2013.01); *H01F 41/10* (2013.01); *H01F 17/04* (2013.01); *H01F 27/28* (2013.01); *H01F 41/04* (2013.01)

(58) Field of Classification Search

CPC ..... H01F 17/045; H01F 41/06; H01F 41/10; H01F 17/04; H01F 41/04; H01F 27/28; H01F 27/29; Y10T 29/4902; Y10T 29/49071; Y10T 29/49075

USPC ..... 29/605, 602.1, 607; 336/199

See application file for complete search history.

(56) References Cited

U.S. PATENT DOCUMENTS

| | | | | |
|---|---|---|---|---|
| 6,348,850 | B1 * | 2/2002 | Kimura | H01F 17/045 336/200 |
| 6,965,289 | B2 * | 11/2005 | Toi | H01F 17/045 336/200 |
| 7,212,093 | B2 * | 5/2007 | Singu | H01F 17/045 336/83 |
| 7,633,366 | B2 * | 12/2009 | Hirai | H01F 17/045 336/83 |
| 7,791,444 | B2 * | 9/2010 | Tomonari | H01F 27/29 336/192 |
| 7,932,803 | B2 * | 4/2011 | Hirai | H01F 17/045 29/602.1 |
| 8,044,753 | B2 * | 10/2011 | Azuma | H01F 17/04 336/192 |
| 9,177,710 | B2 * | 11/2015 | Lee | H01F 27/26 |
| 9,196,415 | B2 * | 11/2015 | Takagi | H01F 27/29 |

(Continued)

FOREIGN PATENT DOCUMENTS

JP 2003-086442 A 3/2003

*Primary Examiner* — Peter Dungba Vo
*Assistant Examiner* — Kaying Kue
(74) *Attorney, Agent, or Firm* — Studebaker & Brackett PC

(57) ABSTRACT

A coil component includes a drum-shaped core having first and second flange portions and a plate-shaped core. The top surface of each of the flange portions has a convex curved surface. At least four protrusions are provided between the lower main surface of the plate-shaped core and the top surfaces of the flange portions and contact with the lower main surface and the top surfaces of the flange portions.

7 Claims, 7 Drawing Sheets

(56) References Cited

U.S. PATENT DOCUMENTS

| | | | | |
|---|---|---|---|---|
| 9,767,952 | B2 * | 9/2017 | Hamamura | G01R 33/04 |
| 9,767,953 | B2 * | 9/2017 | Fan | H01F 27/2828 |
| 2002/0057160 | A1 * | 5/2002 | Hanato | H01F 17/045 336/83 |
| 2008/0136286 | A1 * | 6/2008 | Hiramatsu | H02K 3/18 310/216.004 |
| 2008/0309445 | A1 * | 12/2008 | Suzuki | H01F 27/2823 336/183 |
| 2009/0045902 | A1 * | 2/2009 | Hirai | H01F 17/045 336/192 |
| 2009/0231078 | A1 * | 9/2009 | Watanabe | H01F 5/02 336/192 |
| 2009/0315659 | A1 * | 12/2009 | Sato | H01F 17/045 336/192 |
| 2009/0315660 | A1 * | 12/2009 | Oki | H01F 17/045 336/192 |
| 2010/0321145 | A1 * | 12/2010 | Kaoru | H01F 27/2847 336/222 |
| 2011/0115593 | A1 * | 5/2011 | Liao | H01F 27/02 336/90 |

* cited by examiner

COIL COMPONENT

CROSS REFERENCE TO RELATED APPLICATIONS

This application claims benefit of priority to Japanese Patent Application 2016-139852 filed Jul. 15, 2016, the entire content of which is incorporated herein by reference.

TECHNICAL FIELD

The present disclosure relates to a coil component, and more particularly to a coil component that includes a substantially drum-shaped core including a winding core portion, around which a wire is wound, and first and second flange portions, which are formed at opposite end portions of the winding core portion, and a substantially plate-shaped core provided so as to extend between the first and second flange portions.

BACKGROUND

An example of a technology related to the present disclosure is a coil component described in Japanese Unexamined Patent Application Publication No. 2003-86442. Japanese Unexamined Patent Application Publication No. 2003-86442 describes a wire-wound coil component such as that described below. FIGS. 5A and 5B illustrate a coil component 1 having a configuration substantially the same as that of the coil component described in Japanese Unexamined Patent Application Publication No. 2003-86442. FIG. 5A is a front view of the coil component 1, and FIG. 5B is a left side view of the coil component 1.

Referring to FIGS. 5A and 5B, the coil component 1 includes a substantially drum-shaped core 2 made of, for example, a magnetic material such as ferrite. The substantially drum-shaped core 2 includes a winding core portion 3 and first and second flange portions 4 and 5, which are formed at opposite end portions of the winding core portion 3.

The first flange portion 4 includes an inner end surface 6, an outer end surface 8, which is opposite to the inner end surface 6, a bottom surface 10, which connects the inner end surface 6 and the outer end surface 8 to each other, and a top surface 12, which is opposite to the bottom surface 10. The second flange portion 5 includes an inner end surface 7, an outer end surface 9, which is opposite to the inner end surface 7, a bottom surface 11, which connects the inner end surface 7 and the outer end surface 9 to each other, and a top surface 13, which is opposite to the bottom surface 11. The inner end surfaces 6 and 7 face the winding core portion 3 and define the positions of the corresponding end portions of the winding core portion 3. The outer end surfaces 8 and 9 face outward. The bottom surfaces 10 and 11 face a mounting substrate (not illustrated) when the coil component 1 is mounted on the mounting substrate.

In addition, the coil component 1 includes a substantially plate-shaped core 14 provided so as to extend across the first and second flange portions 4 and 5. The substantially plate-shaped core 14 is fixed to the flange portions 4 and 5 with an adhesive 15. Similar to the substantially drum-shaped core 2, the substantially plate-shaped core 14 is also made of, for example, a magnetic material such as ferrite. The substantially plate-shaped core 14 forms a closed magnetic circuit with the substantially drum-shaped core 2.

A first terminal electrode 16 is provided on the side on which the bottom surface 10 of the first flange portion 4 is present, and a second terminal electrode 17 is provided on the side on which the bottom surface 11 of the second flange portion is present. A wire 18, which connects the first terminal electrode 16 and the second terminal electrode 17 to each other, is wound around the winding core portion 3.

SUMMARY

When the substantially drum-shaped core 2, which is included in the coil component 1 having a configuration such as that described above, is manufactured, a process of firing a green substantially drum-shaped core is performed, and a green substantially drum-shaped core is usually obtained by die pressing a powder containing a magnetic material. In this manner, a green substantially drum-shaped core can be manufactured at a relatively low cost. However, in the process of obtaining a green substantially drum-shaped core, the pressure applied to the powder is less likely to be uniform in the entire green substantially drum-shaped core due to, for example, the presence of a portion that is to be the winding core portion 3.

Thus, the following undesirable deformation may sometimes occur in the substantially drum-shaped core 2 obtained through a firing process. FIG. 6 illustrates the first flange portion 4. As indicated by the one-dot chain line in FIG. 6, there is a case where at least a portion of the top surface 12 of the first flange portion 4 has a convex curved surface 19. Although not particularly illustrated, there may be a case where deformation similar to the above occurs in the second flange portion 5.

Although the difference in the height of the top surface 12 due to the curved surface 19 is about 10 μm, the difference in the height due to the curved surface 19 is exaggerated in FIG. 6 and similar drawings.

When the substantially plate-shaped core 14 is displaced on the flange portions 4 and 5, which have the top surface 12 and the top surface 13, respectively, and in each of which the above-mentioned curved surface 19 is formed, the substantially plate-shaped core 14 is inclined as illustrated in FIG. 7. Thus, the sizes of gaps 20 between the substantially plate-shaped core 14 and the flange portions 4 and 5 are inconsistent, which results in variations in inductance.

In order to address the above problem, making the pressure applied to a green substantially drum-shaped core uniform by applying additional pressure in another direction to the green substantially drum-shaped core when shaping the green substantially drum-shaped core or making curved surfaces in the top surfaces 12 and 13 of the flange portions 4 and 5 flat in a subsequent process may be considered. However, in these cases, the manufacturing cost is increased.

Although not illustrated in FIG. 6 and FIG. 7, convex curved surfaces may be formed not only in the top surfaces 12 and 13 of the flange portions 4 and 5 but also in the bottom surfaces 10 and 11, which are opposite to the top surfaces 12 and 13. However, since only the convex curved surfaces 19 in the top surfaces 12 and 13 of the flange portions 4 and 5, which face the substantially plate-shaped core 14, are relevant to the present disclosure, illustration and further description of convex curved surfaces in the bottom surfaces 10 and 11 will be omitted.

Accordingly, it is an object of the present disclosure to provide a coil component capable of reducing variations in inductance due to variations in the gaps between flange portions and a substantially plate-shaped core without an increase in manufacturing cost.

A coil component according to a one embodiment of the present disclosure includes a substantially drum-shaped core including a winding core portion and first and second flange portions, which are formed at opposite end portions of the winding core portion, a substantially plate-shaped core having a lower main surface and an upper main surface, which face opposite directions, the substantially plate-shaped core extending across the first and second flange portions, at least one first terminal electrode formed on the first flange portion, at least one second terminal electrode formed on the second flange portion, and at least one wire wound around the winding core portion, the wire connected to the first terminal electrode and the second terminal electrode.

Each of the first and second flange portions has an inner end surface, which faces the winding core portion and on which a corresponding one of the end portions of the winding core portion is disposed, an outer end surface, which is opposite to the inner end surface and which faces outward, a bottom surface, which connects the inner end surface and the outer end surface and which faces a mounting substrate when the coil component is mounted on the mounting substrate, and a top surface, which is opposite to the bottom surface.

The top surface of each of the first and second flange portions has a convex curved surface. The lower main surface faces the top surfaces of the first and second flange portions.

At least two protrusions are provided between the lower main surface and the top surface of the first flange portion and contact with both of the lower main surface and the top surface of the first flange portion, and at least two protrusions are provided between the lower main surface and the top surface of the second flange portion and contact with both of the lower main surface and the top surface of the second flange portion.

As described above, the sizes of the gaps between the flange portions and the substantially plate-shaped core are controlled by the heights of the protrusions. Therefore, the sizes of the gaps between the flange portions and the substantially plate-shaped core can be easily kept constant.

In the one embodiment of the present disclosure, it is preferable that all the protrusions be formed on the substantially plate-shaped core because it is easier to form the protrusions on the substantially plate-shaped core than to form the protrusions on the flange portions of the substantially drum-shaped core.

In the above case, it is further preferable that the lower main surface of the substantially plate-shaped core has a substantially rectangular shape and that four of the protrusions be positioned at four corners of the lower main surface of the substantially plate-shaped core. In this configuration, the position of the substantially plate-shaped core with respect to the substantially drum-shaped core can be easily stabilized.

In the one embodiment of the present disclosure, it is preferable that, when viewed in a see-through manner from the upper main surface of the substantially plate-shaped core toward the bottom surfaces of the flange portions, the protrusions be located outside extension lines of outlines of the winding core portion, the extension lines extending into the flange portions. In each of the top surfaces of the flange portions, a portion having the smallest height is usually located outside the above-mentioned extension lines of outlines of the winding core portion extending into the flange portions. In addition, portions of the top surfaces located outside the extension lines of the outlines of the winding core portion extending into the flange portion are usually not bent. Thus, in this configuration, the sizes of gaps between the flange portions and the substantially plate-shaped core can be effectively kept constant by the protrusions.

It is preferable that the height of each of the protrusions be substantially equal to the difference in the height of each of the top surfaces due to the corresponding curved surface. In this configuration, as a result of the curved surfaces and the substantially plate-shaped core coming into contact with each other, the magnetic flux density in the core increases, and the inductance can be increased.

Alternatively, the height of each of the protrusions may be larger than the difference in the height of each of the top surfaces due to the corresponding curved surface by about 10 μm or more. In this configuration, the gaps can be formed with certainty between the flange portions and the substantially plate-shaped core across the entire top surfaces of the flange portions including portions of the top surfaces, the portions each having the largest height. Therefore, variations in magnetic flux can be suppressed. In addition, direct current superposition characteristics can be improved.

It is further preferable that, in addition to the above-mentioned condition of the height of each of the protrusions, another condition be satisfied, the other condition being that a contact area between the protrusions and one of the lower main surface of the substantially plate-shaped core and the top surface of the first flange portion is sufficiently small, which is about one-fiftieth or less the overlapped area where the lower main surface of the substantially plate-shaped core and the top surface of the first flange portion overlapped each other. In this configuration, the magnetic reluctance of the protrusions can be about five-fold or higher the magnetic reluctance of portions excluding the protrusions, and the influence of the protrusions on the entire direct current superposition characteristics can be sufficiently reduced.

According to a coil component of a one embodiment of the present disclosure, the sizes of the gaps between flange portions and a substantially plate-shaped core can be kept constant in a favorable balance by protrusions, and thus, variations in inductance due to variations in the gaps between the flange portions and the substantially plate-shaped core can be reduced.

In addition, since it is not necessary to perform a process for making curved surfaces in the top surfaces of the flange portions flat, the manufacturing costs can be kept low.

Other features, elements, characteristics and advantages of the present disclosure will become more apparent from the following detailed description with reference to the attached drawings.

DETAILED DESCRIPTION

A coil component 21 according to an embodiment of the present disclosure will now be described with reference to FIG. 1A to FIG. 4.

Figure 1A:
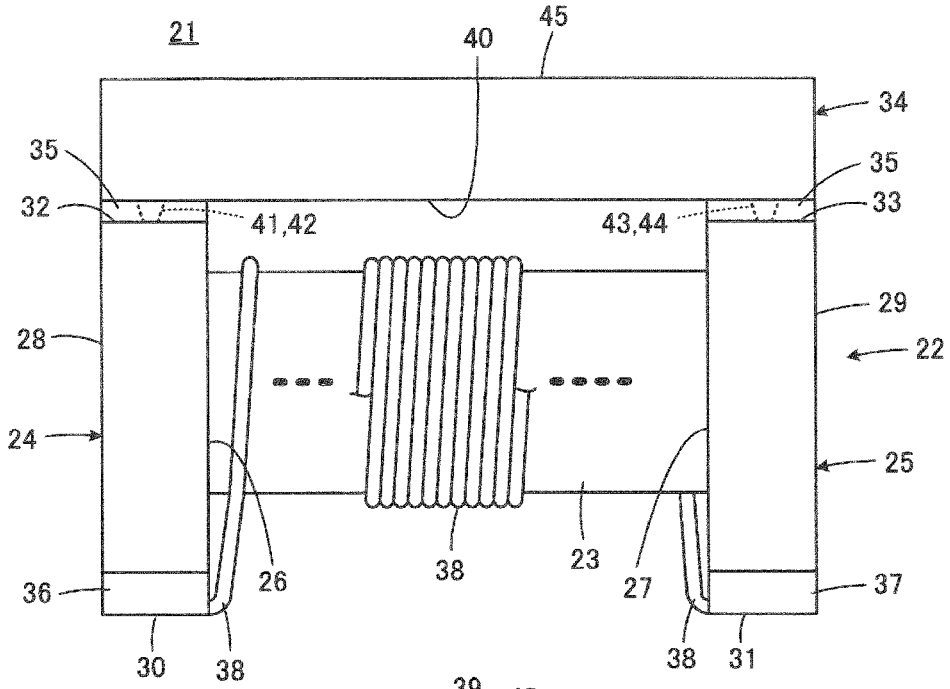
FIGS. 1A and 1B are a front view and a left side view, respectively, each illustrating a coil component according to an embodiment of the present disclosure.
Figure 1B:
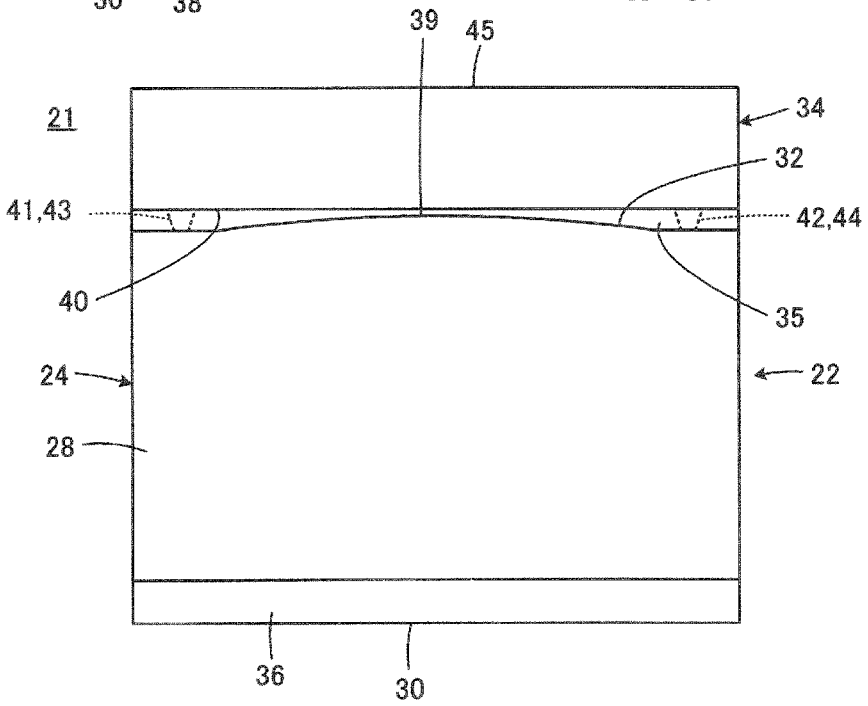
Figure 2:
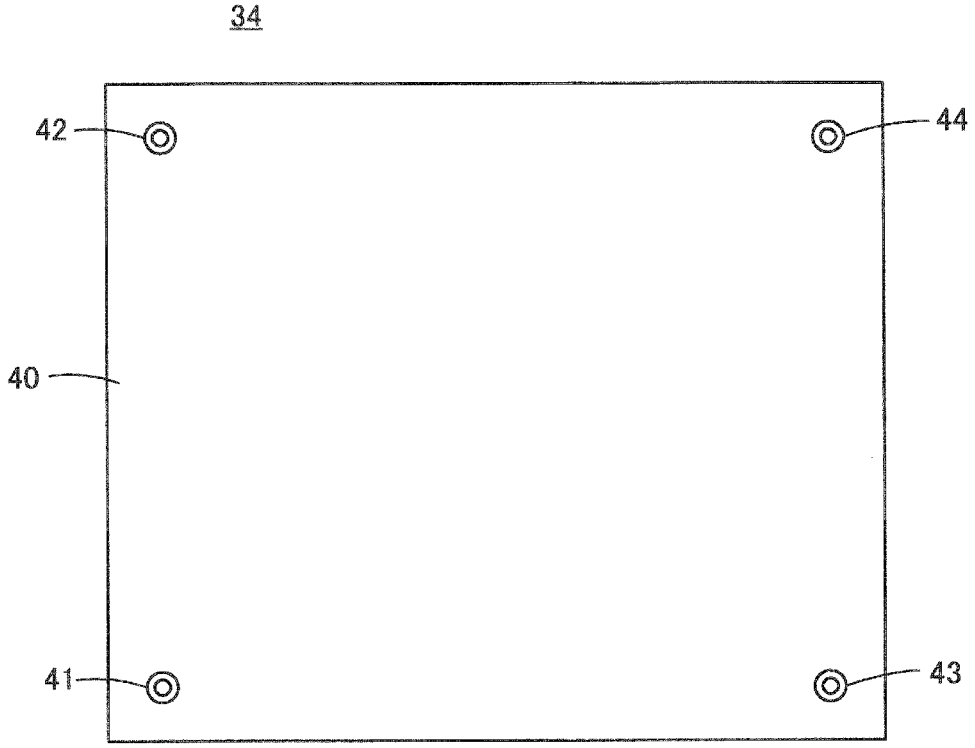
FIG. 2 is a diagram illustrating a lower main surface of a substantially plate-shaped core included in the coil component illustrated in FIGS. 1A and 1B.
Figure 5A:
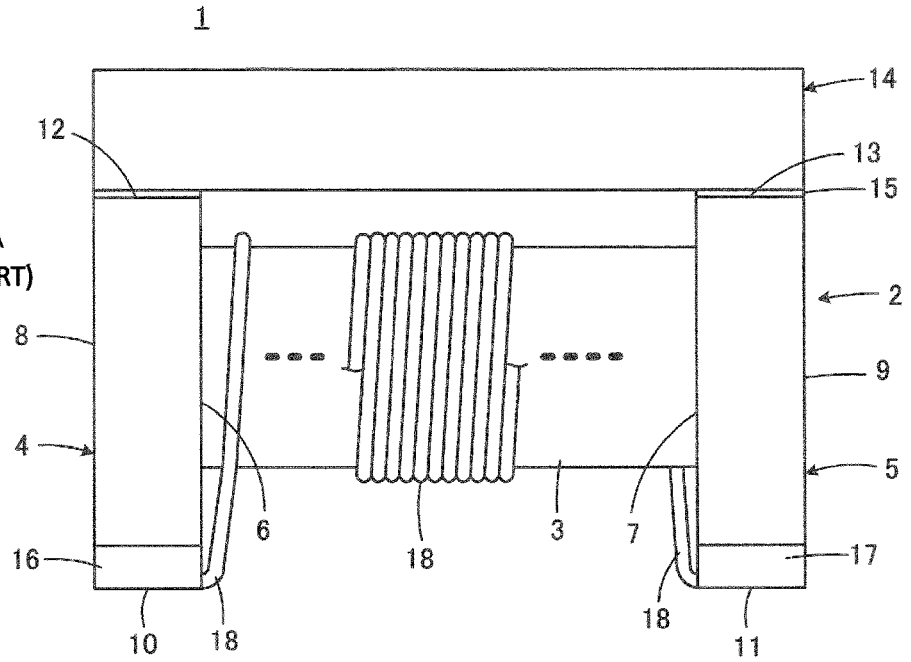
FIG. 5A (PRIOR ART)
FIGS. 5A and 5B are a front view and a left side view, respectively, each illustrating the coil component related to the present disclosure.
Figure 5B:
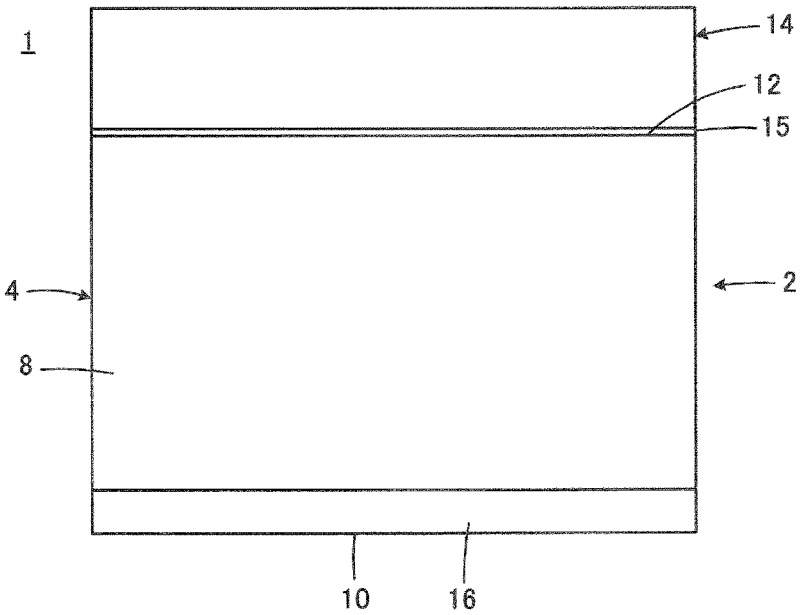
FIG. 5B (PRIOR ART)
Figure 6:
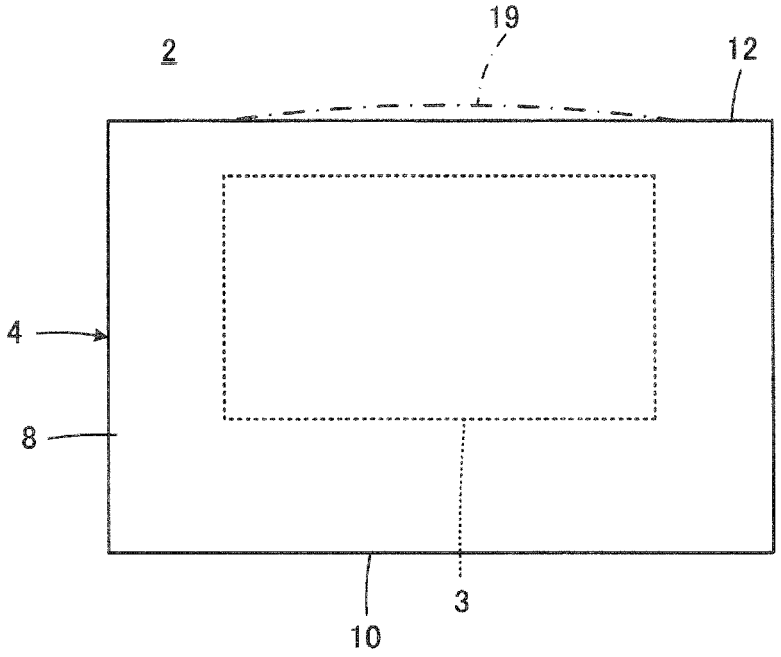
FIG. 6 is a left side view of the substantially drum-shaped core illustrating a problem to be solved by the present disclosure.
Figure 7:
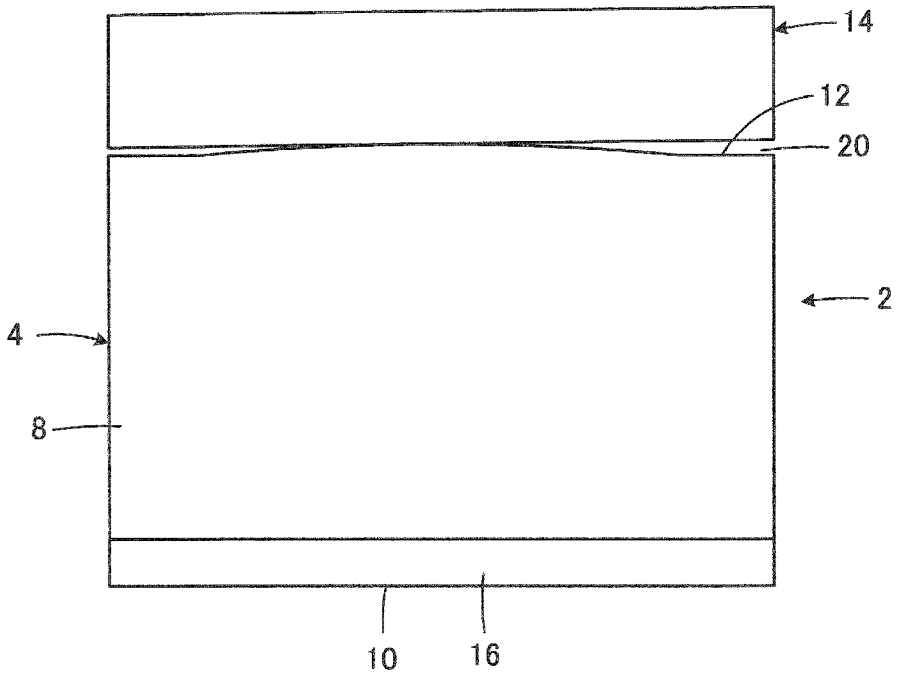
FIG. 7 is a left side view illustrating the problem to be solved by the present disclosure and illustrating a state where the substantially plate-shaped core is placed on the substantially drum-shaped core having a top surface, in which a convex curved surface is formed, the state being illustrated in FIGS. 5A and 5B.

As in the case of the coil component 1 illustrated in FIGS. 5A and 5B, the coil component 21 includes a substantially drum-shaped core 22 made of, for example, a magnetic material such as ferrite, as illustrated in FIGS. 1A and 1B. The substantially drum-shaped core 22 includes a winding core portion 23 and first and second flange portions 24 and 25, which are formed at opposite end portions of the winding core portion 23.

The first flange portion 24 includes an inner end surface 26, an outer end surface 28, which is opposite to the inner end surface 26, a bottom surface 30, which connects the inner end surface 26 and the outer end surface 28, and a top surface 32, which is opposite to the bottom surface 30. The second flange portion 25 includes an inner end surface 27, an outer end surface 29, which is opposite to the inner end surface 27, a bottom surface 31, which connects the inner end surface 27 and the outer end surface 29 to each other, and a top surface 33, which is opposite to the bottom surface 31. The inner end surfaces 26 and 77 face the winding core portion 23 and the corresponding end portions of the winding core portion 23 are disposed on the inner end surfaces 26 and 77. The outer end surfaces 28 and 29 face outward. The bottom surfaces 30 and 31 face a mounting substrate (not illustrated) when the coil component 21 is mounted on the mounting substrate.

In addition, the coil component 21 includes a substantially plate-shaped core 34 provided so as to extend across the first and second flange portions 24 and 25. The substantially plate-shaped core 34 is fixed to the flange portions 24 and 25 with an adhesive 35 containing, for example, a resin material such as an epoxy resin. Similar to the substantially drum-shaped core 22, the substantially plate-shaped core 34 is also made of, for example, a magnetic material such as ferrite. The substantially plate-shaped core 34 forms a closed magnetic circuit with the substantially drum-shaped core 22. The adhesive 35 may contain a filler.

A first terminal electrode 36 is formed on the side at which the bottom surface 30 of the first flange portion 24 is present, and a second terminal electrode 37 is formed on the side at which the bottom surface 31 of the second flange portion 25 is present. For example, the terminal electrodes 36 and 37 are formed by printing and then baking a conductive paste containing a conductive metal powder, such as silver (Ag) powder, on the first flange portion 24 and the second flange portion 25, and in addition, by plating the conductive paste with nickel and tin. Alternatively, the terminal electrodes 36 and 37 may be formed by, for example, attaching a piece of conductive metal made of a copper-based metal, such as tough pitch copper or phosphor bronze, to the flange portions 24 and 25.

A wire 38 is wound around the winding core portion 23. For example, the wire 38 is a copper wire provided with an insulating coating of a resin, such as polyurethane, polyesterimide, or polyamidoimide. A first end of the wire 38 is connected to the first terminal electrode 36, and a second end of the wire 38 is connected to the second terminal electrode 37. For example, thermocompression bonding, ultrasonic welding, laser welding, or the like is used for connecting the terminal electrodes 36 and 37 and the wire 38 to each other.

Figure 3:
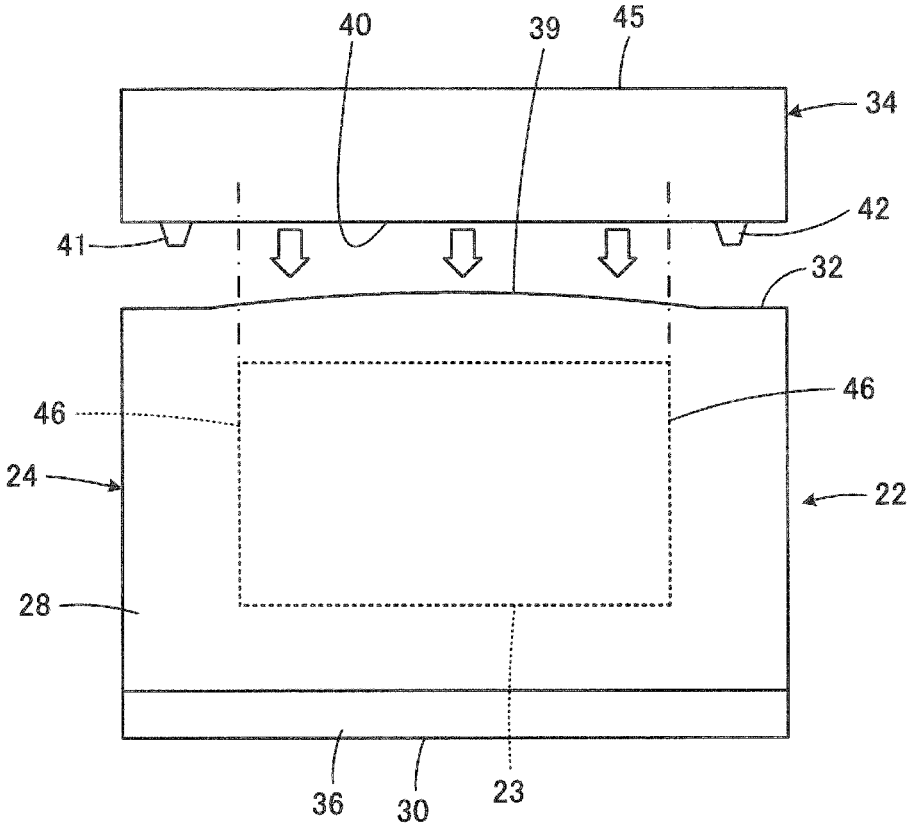
FIG. 3 is a left side view illustrating the coil component, which is illustrated in FIGS. 1A and 1B and which is in the process of being manufactured, and illustrating a state where a substantially drum-shaped core and the substantially plate-shaped core are isolated from each other.
Figure 4:
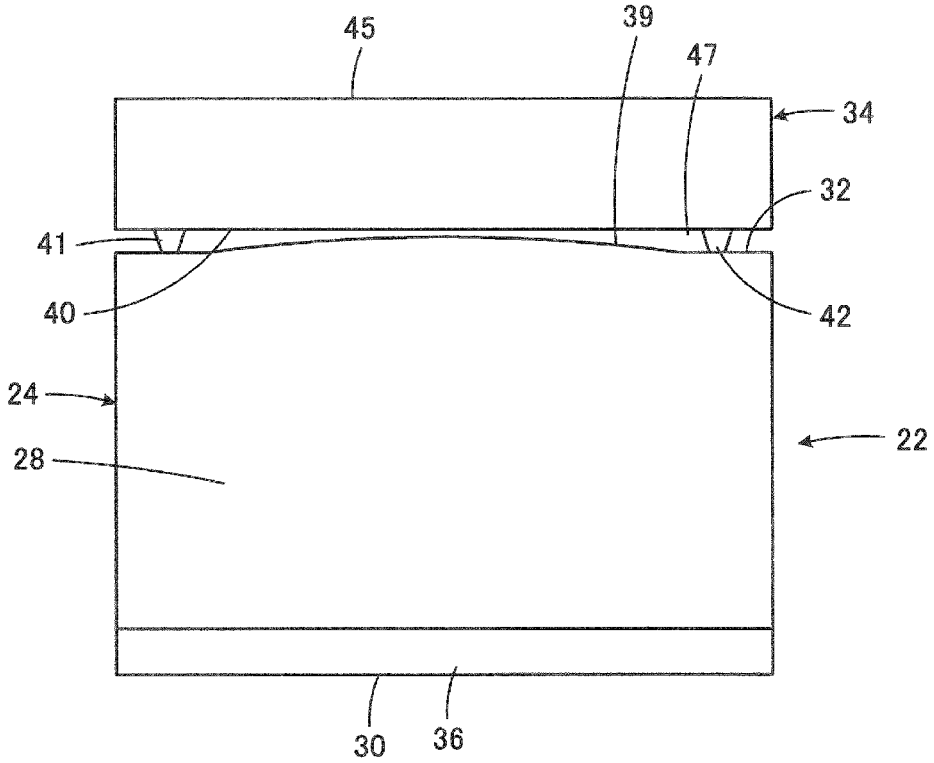
FIG. 4 is a left side view illustrating the coil component, which is illustrated in FIGS. 1A and 1B and which is in the process of being manufactured, and illustrating a state where the substantially plate-shaped core is placed on the substantially drum-shaped core.

In addition, as described above, in the substantially drum-shaped core 22 obtained through a firing process, the top surface 32 of the first flange portion 24 has a convex curved surface 39 as a result of a low-cost manufacturing method, as illustrated in FIG. 1B, FIG. 3, and FIG. 4. In FIG. 1B, FIG. 3, and FIG. 4, although the second flange portion 25 is not illustrated, whereas the first flange portion 24 is illustrated, the top surface 33 of the second flange portion 25 has another convex curved surface 39.

A lower main surface 40 of the substantially plate-shaped core 34 faces the top surfaces 32 and 33 of the first and second flange portions 24 and 25. In order to prevent the substantially plate-shaped core 34 from being inclined due to the presence of the above-described curved surfaces 39, as clearly illustrated in FIG. 2, four protrusions 41 to 44 are formed on the lower main surface 40 of the substantially plate-shaped core 34. The four protrusions 41 to 44 are brought into contact with the top surfaces 32 and 33 of the flange portions 24 and 25. In other words, the four protrusions 41 to 44 are positioned in a region in which the lower main surface 40 of the substantially plate-shaped core 34 and the top surfaces 32 and 33 of the first and second flange portions 24 and 25 face each other.

The four protrusions 41 to 44 are distributed such that each two of the four protrusions 41 to 44 are provided on the side on which the first flange portion 24 is disposed and on the side on which the second flange portion 25 is disposed. In other words, the protrusions 41 and 42 are provided on the side on which the first flange portion 24 is disposed, and the protrusions 43 and 44 are provided on the side on which the second flange portion 25 is disposed. In the present embodiment, the four protrusions 41 to 44 are positioned at four corners of the substantially rectangular lower main surface 40 of the substantially plate-shaped core 34. In this configuration, the position of the substantially plate-shaped core 34 with respect to the substantially drum-shaped core 22 can be easily stabilized.

When viewed in a see-through manner from an upper main surface 45 of the substantially plate-shaped core 34 toward the bottom surfaces 30 and 31 of the flange portions 24 and 25, it is preferable that the protrusions 41 to 44 be located outside extension lines 46 of outlines of the winding core portion 23, the extension lines 46 extending into the flange portions 24 and 25. In each of the top surfaces 32 and 33 of the flange portions 24 and 25, a portion having the smallest height is usually located outside the above-mentioned extension line 46 of the outline of the winding core portion 23 extending into the flange portions 24 and 25. In addition, portions of the top surfaces 32 and 33 located outside the extension line 46 of the outline of the winding core portion 23 extending into the flange portions 24 and 25 are usually not bent. Thus, according to the preferred configuration, as illustrated in FIG. 4, the sizes of gaps 47 between the flange portions 24 and 25 and the substantially plate-shaped core 34 can be effectively kept constant by the protrusions 41 to 44.

The above-mentioned gaps 47 are filled with the adhesive 35, and as a result, the substantially plate-shaped core 34 is fixed onto the substantially drum-shaped core 22.

It is preferable that the height of each of the protrusions 41 to 44 be larger than the difference in the height of each of the top surfaces 32 and 33 due to the corresponding curved surface 39 by about 10 μm or more. In this configuration, the gaps 47 can be formed with certainty between the flange portions 24 and 25 and the substantially plate-shaped core 34 across the entire top surfaces 32 and 33 of the flange portions 24 and 25 including portions of the top surfaces 32 and 33, the portions each having the largest height. Therefore, variations in magnetic flux can be suppressed. In addition, direct current superposition characteristics can be improved.

It is further preferable that, in addition to the above-mentioned condition of the height of each of the protrusions 41 to 44, another condition be satisfied, the other condition being that a contact area between the top surfaces 32 and 33 of the flange portions 24 and 25 and the protrusions 41 to 44 is sufficiently small, which is about one-fiftieth or less the corresponding overlapped area where the lower main surface of the substantially plate-shaped core 34 and the corresponding one of the top surfaces 32 and 33 of the first and second flange portions 24 and 25 overlapped each other. In this configuration, the magnetic reluctance of the protrusions 41 to 44 can be about five-fold or higher the magnetic reluctance of portions excluding the protrusions 41 to 44, and the influence of the protrusions 41 to 44 on the entire direct current superposition characteristics can be sufficiently reduced.

In the above-described embodiment, although all the protrusions 41 to 44 are formed on the substantially plate-shaped core 34, the protrusions 41 to 44 may be formed on the flange portions 24 and 25 of the substantially drum-shaped core 22. Alternatively, some of the protrusions 41 to 44 may be formed on the substantially plate-shaped core 34, and the rest of the protrusions 41 to 44 may be formed on the flange portions 24 and 25 of the substantially drum-shaped core 22.

In addition, in the above-described embodiment, although the four protrusions 41 to 44 are provided, the number of the protrusions may be five or larger.

The shape of each of the protrusions 41 to 44 is not limited to a substantially circular truncated cone, which is illustrated in the drawings, and may be any shape such as, for example, a substantially columnar shape, a substantially rectangular columnar shape, or the like.

In addition, the height of each of the protrusions 41 to 44 may be substantially equal to the difference in the height of each of the top surfaces 32 and 33 due to the corresponding curved surface 39. In this configuration, as a result of the curved surfaces 39 and the substantially plate-shaped core 34 coming into contact with each other, the magnetic flux density in the substantially drum-shaped core 22 and the magnetic flux density in the substantially plate-shaped core 34 increase, and the inductance can be increased.

In addition, in the above-described embodiment, although the coil component 21 forms a single coil, the coil component 21 may form a pulse transformer, a common-mode choke coil, or the like. Therefore, two or more wires may be provided, and accordingly, each of the flange portions 24 and 25 may be provided with two or more terminal electrodes.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A coil component comprising:

a drum-shaped core including a winding core portion, a first flange portion, and a second flange portion, the first and second flange portions being formed at opposite end portions of the winding core portion;

a plate-shaped core having a lower main surface and an upper main surface, which face opposite directions, the plate-shaped core extending across the first and second flange portions;

at least one first terminal electrode formed on the first flange portion;

at least one second terminal electrode formed on the second flange portion; and at least one wire wound around the winding core portion and connected to the first terminal electrode and the second terminal electrode, wherein each of the first and second flange portions has an inner end surface, which faces the winding core portion and on which a corresponding one of the end portions of the winding core portion is disposed, an outer end surface, which is opposite to the inner end surface and which faces outward, a bottom surface, which connects the inner end surface and the outer end surface and which faces a mounting substrate when the coil component is mounted on the mounting substrate, and a top surface, which is opposite to the bottom surface, wherein the top surface of each of the first and second flange portions has a convex curved surface, wherein the lower main surface faces the top surfaces of the first and second flange portions, wherein at least two protrusions are provided between the lower main surface and the top surface of the first flange portion and contact with both of the lower main surface and the top surface of the first flange portion, and wherein at least two protrusions are provided between the lower main surface and the top surface of the second flange portion and contact with both of the lower main surface and the top surface of the second flange portion.

2. The coil component according to claim 1, wherein all the protrusions are formed on the plate-shaped core.

3. The coil component according to claim 1, wherein the lower main surface has a shape having four sides and four corners, and wherein four of the protrusions are positioned at the four corners of the lower main surface.

4. The coil component according to claim 1, wherein, when viewed in a see-through manner from the upper main surface toward the bottom surfaces, the protrusions are located outside extension lines of outlines of the winding core portion, the extension lines extending into the first and second flange portions.

5. The coil component according to claim 1, wherein a height of each of the protrusions is substantially equal to a difference in a height of each of the top surfaces corresponding to the convex curved surface.

6. The coil component according to claim 1, wherein a height of each of the protrusions is larger than a difference in a height of each of the top surfaces corresponding to the convex curved surface by about 10 μm or more.

7. The coil component according to claim 6, wherein a contact area between the protrusions and one of the lower main surface and the top surface of the first flange portion is not more than about one-fiftieth an overlapped area where the lower main surface and the top surface of the first flange portion overlapped each other.

* * * * *